United States Patent [19]

Pischdotchian

[11] Patent Number: 4,505,283

[45] Date of Patent: Mar. 19, 1985

[54] HAIR TRIMMING COMB

[76] Inventor: Vahan Pischdotchian, 106 Russell Ave., Watertown, Middlesex County, Mass. 02172

[21] Appl. No.: 423,632

[22] Filed: Sep. 27, 1982

[51] Int. Cl.[3] ..... A45D 24/36

[52] U.S. Cl. ..... 132/45 R; 132/126

[58] Field of Search ..... 132/45, 136, 138, 133, 132/129, 131, 113, 126–128

[56] References Cited

U.S. PATENT DOCUMENTS

| | | | |
|---|---|---|---|
| 2,325,246 | 7/1943 | Halen | 132/45 R |
| 3,354,890 | 11/1967 | Collison | 132/136 |
| 3,464,427 | 9/1969 | Abraham | 132/136 |
| 3,572,351 | 3/1971 | Perry | 132/45 R |
| 3,603,324 | 9/1971 | Cutrone | 132/136 |
| 3,638,665 | 2/1972 | Staffas, Sr. | 132/45 A |

*Primary Examiner*—Gregory E. McNeill

[57] ABSTRACT

A hair trimming comb comprising a fixed comb element and a movable comb element, the movable element being arranged to translate longitudinally of the fixed element, elastic means urging the movable comb into a normally aligned position with the teeth of the movable comb element overlapped with the teeth of the fixed comb element, the movable comb element being provided with a handle located centrally of the comb yet near to the teeth of the comb.

5 Claims, 9 Drawing Figures

HAIR TRIMMING COMB

BACKGROUND OF THE INVENTION

Numerous devices have been made to aid the amateur in cutting hair, and in maintaining a hair style once it is established. An experienced hair stylist gauges the length of a person's hair by using a conventional comb and scissors to comb the hair out and then holding the comb a selected distance away from the head to cut the excess hair. This process is repeated over the entire head so that essentially all of the hair is cut to the desired length.

Once a desired cut is obtained it is usually necessary to have the hair trimmed at regular intervals to maintain the fresh appearance of the desired hair style. In order to save the costs of frequent visits to the professional stylist it is desireable to provide a hair trimming comb which functions as a precision instrument in keeping the hair tightly held at any desired position while the hair is cut. The device of the invention enables a person to hold the hair at the desired distance while manipulating a pair of scissors to cut the hair. Normally, whereas a barber holds the hair in his fingers to cut it, the fixed nature of the device enables it to serve as a training aid for barber students. It also enables the cutting of the hair of energetic younger persons.

DESCRIPTION OF THE DRAWINGS

The invention will now be described in greater detail with reference to the accompanying drawings, in which.

Figure 1:
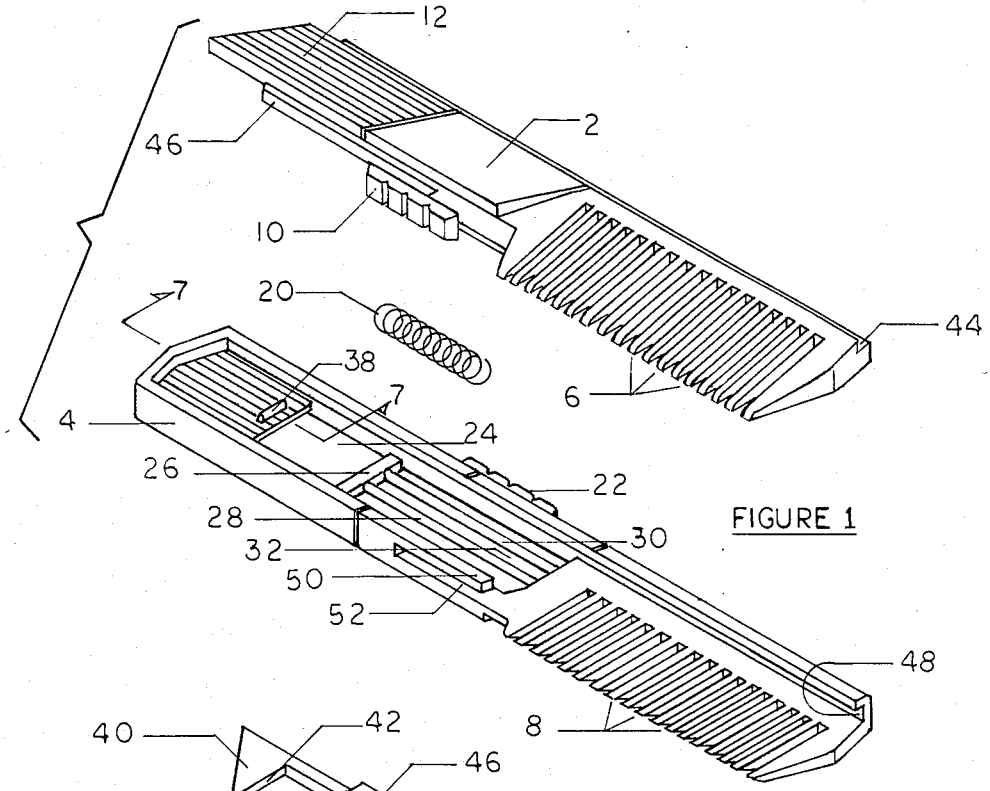
FIG. 1 is an exploded perspective view of the hair trimming comb of the invention.
Figure 2:
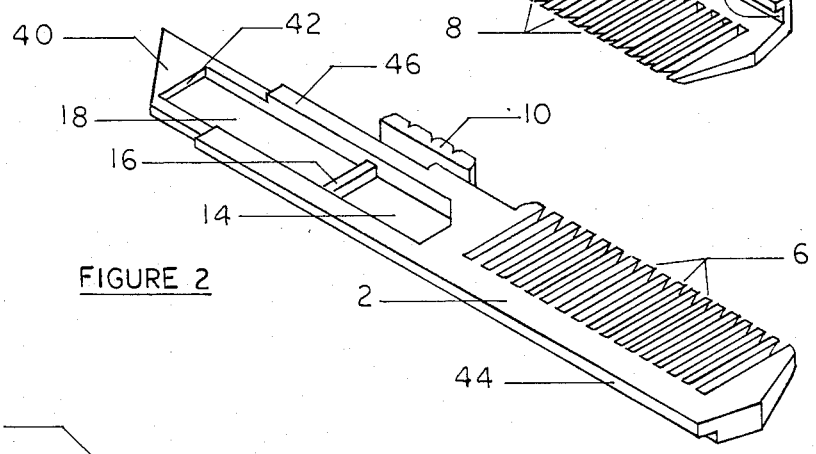
FIG. 2 is a bottom view of the movable comb element of the device shown in FIG. 1.
Figure 5:
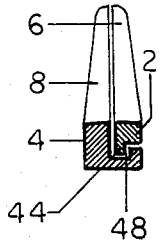
FIG. 5 is a cross-sectional view taken along lines 5—5 of FIG. 3.
Figure 6:
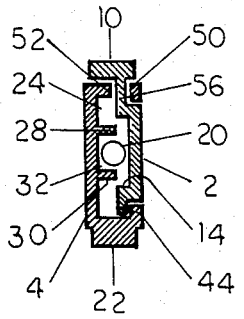
FIG. 6 is a cross-sectional view taken along lines 6—6 of FIG. 3.
Figure 8:
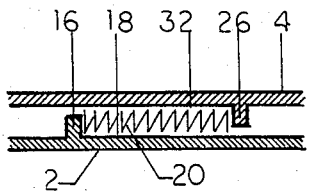
FIG. 8 is a partial cross-sectional view internally of the comb elements when they are in the normally aligned position.

Referring now more specifically to the drawings, it is seen in FIG. 1 that the hair trimming comb 1 comprises a first comb element 2 and a second comb element 4. Each of the comb elements 2 and 4 are provided with a series of partial teeth 6,6,6 and 8,8,8, respectively. These partial teeth, as more clearly shown in FIG. 5 are complementary to each other and form a single unitary tooth when in the aligned position.

The comb element 2 has the partial teeth 6,6,6 formed at one end thereof and at a central position has a serrated or knurled knob, or operating element, 10, formed thereon. The remainder of the element 2 is formed as a handle which may be of a ribbed configuration as shown in order to facilitate positive gripping.

The underside of the comb element 2 is formed centrally with a rib 16 extending across a hollowed out portion 18, the forward end of the portion 18 being formed by the rib 16 into a hollowed compartment 14 to receive a spring 20 (as described hereafter).

The comb element has the partial teeth 8,8,8 formed at one end thereof and at a central position has a serrated or knurled knob, or holding element, 22 formed thereon. The remainder of the element 4 is formed as a handle which complements the juxtaposed handle of the element 2. However, as shown in FIG. 1 the underside of the element 4 is provided with a hollowed out area 24 which has a transverse rib 26 extended across it. A pair of longitudinally extending ribs 28 and 30 running from the rib 26 to the front of the element 4 containing the comb teeth serve to divide the area 24 into a compartment 32, which mates with the compartment 14 in the comb element 2 to form a chamber to retain and hold a spring 20, as shown in FIGS. 1, 6, 8 and 9.

Figure 3:
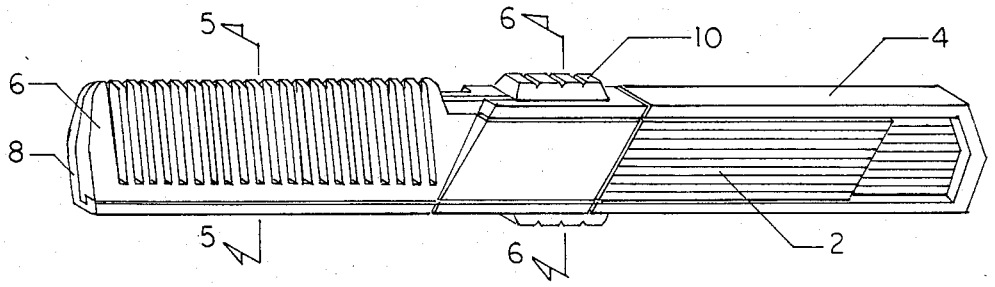
FIG. 3 is a side view of the assembled hair trimming comb of FIG. 1 showing the movable comb element in the normally closed position.
Figure 4:
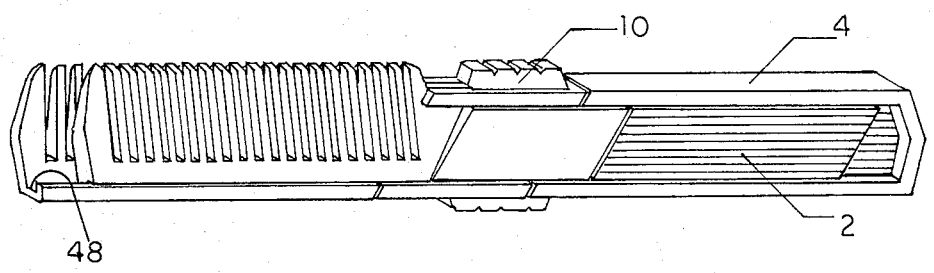
FIG. 4 is a side view similar to that of FIG. 3 but showing the movable comb element moved to a position away from its normally closed position.
Figure 9:
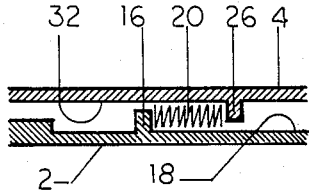
FIG. 9 is a partial cross-sectional view internally of the comb elements when they are in the position shown in FIG. 4.

As shown in FIGS. 3 and 4 the comb can be moved from a normally closed position as shown in FIG. 3, wherein the elements 2 and 4 are fully extended by the spring 20 (see FIG. 8), so that the partial teeth 6,6,6 and 8,8,8 are aligned. By grasping the knob 10 and moving it towards the right, as viewed in FIG. 3, the spring 20 will be compressed as shown in FIG. 9, and the comb can then be brought into the position shown in FIG. 4.

In order to retain the two comb elements in position relative to one another the comb element is provided with a pair of ribs 44 and 46 on the outer edges thereof. The rib 44 runs substantially the full length of the element 2 whereas the rib 46 only runs a short distance from the knob 10 rearwardly.

The foregoing described ribs 44 and 46 are arranged to slide within the groove 48 and the underside of the rail 50, respectively. The groove 48 extends substantially the full length of the element 4. The rib 50 is formed in a bifurcated manner from the main body of element 4 to create a slot 52. The knob 10 is formed at the end of a rib 56 which slides within the slot 52 when the two elements 2 and 4 are assembled.

Figure 7:
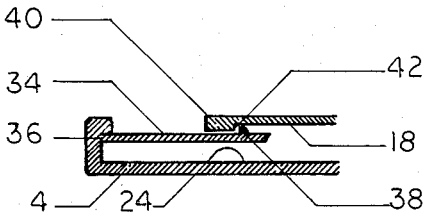
FIG. 7 is a cross-sectional view taken along lines 7—7 of FIG. 1 as it would appear if the two comb elements were in assembled position.

Means are provided to prevent the comb elements from coming apart by being moved too far longitudinally of one another. As shown in FIG. 7, a thin tab element 34 is formed at 36 integrally with the element 4 and extends in a cantilever manner to act as a spring detent into and above the hollowed out area 24. On the forward end of the tab 34 is a stop member 38 which can be in the form of a boss. The handle end of the element 2 has a land area 40. The hollowed out area 18 ends in a wall 42 formed in the land area 40. This wall 42 serves as an abutment to provide a stop for the boss 38, and to prevent any further longitudinal movement of element 2 with respect to element 4.

In operation the sliding element 2 is moved by grasping the knob 10 with the thumb which thereby compresses the spring 20. The comb is held in this fully retracted position while the hair is combed. When the comb is positioned at the desired distance the knob is released to hold the hair at that position and by using a scissors the hair can be cut against the comb as a guide. The spring loaded comb elements serve to hold the hair tightly during the cutting operation.

It is clear that various rearrangements of parts can be made without departing from the spirit and scope of the invention.

What I claim is:

1. A hair trimming comb in which a pair of mating comb elements are arranged to be translated one within the other, means formed in said elements providing stop positions for the translational movement so as to restrict such movement, partial tooth elements formed in said comb elements to provide mating and complementary teeth, positioning means formed on said elements to readily enable movement thereof, and translational tensioning means arranged between said comb elements to normally urge such elements to translate relative to one another to a closed aligned position.

2. The hair trimming comb of claim 1 wherein said elements are provided with a series of ribs and grooves on their outer edges to assure translational movement therebetween.

3. The hair trimming comb of claim 2 wherein one of said elements is provided with a yieldable tab detent element having a boss formed thereon, and the other of said elements has a mating abutment against which the boss is arranged to abut so as to provide a stop means for movement of said comb elements in a first translational direction, said yieldable tab detent element further being arranged to serve as a latch means to allow for disassembly of the comb elements.

4. The hair trimming comb of claim 3 wherein one of said elements is provided with a guide slot and the other of said elements is provided with a rib element arranged to translate within said slot, one end of said slot forming an abutment against which said rib bears to provide a stop means for movement of said comb elements in a second direction.

5. The hair trimming comb of either of claims 2, 3 or 4 wherein said tensioning means is a coiled spring mounted within a chamber formed by the comb elements and so arranged as to urge the comb elements to translate relative to one another into a normally aligned position, and when said spring is compressed to aid in resisting movement of the comb elements beyond one end of travel in one direction.

* * * * *